United States Patent [19]

Ashton

[11] Patent Number: 4,508,230

[45] Date of Patent: Apr. 2, 1985

[54] REVERSIBLE ANGLE DISPLAY

[75] Inventor: Richard D. A. Ashton, Terra Cotta, Canada

[73] Assignee: North American Decorative Products Inc., Bramalea, Canada

[21] Appl. No.: 440,720

[22] Filed: Jan. 26, 1983

[51] Int. Cl.[3] ..... A47F 5/14

[52] U.S. Cl. ..... 211/181; 211/188; 211/126; 211/189; 211/194; 206/509; 312/111; 312/107; 40/308

[58] Field of Search ..... 211/181, 45, 44, 60 R, 211/188, 126, 189, 194; 312/108, 111, 107, 118, 234, 234.1; 206/509; 40/611, 308; 160/350, 135

[56] References Cited

U.S. PATENT DOCUMENTS

| | | | |
|---|---|---|---|
| 2,100,548 | 11/1937 | Maxin . | |
| 3,183,862 | 5/1965 | Melvin . | |
| 3,202,295 | 8/1965 | Drader | 206/509 X |
| 3,223,247 | 12/1965 | Bleed | 211/181 X |
| 3,351,211 | 11/1967 | Best | 211/44 X |
| 3,408,128 | 10/1968 | Kump | 312/234 |
| 3,422,959 | 1/1969 | Sharaf | 211/181 X |
| 3,466,777 | 9/1969 | Wistrand et al. | 40/611 X |
| 3,606,022 | 9/1971 | Beesley, Jr. | 211/181 X |
| 3,680,712 | 8/1972 | Jurasek . | |
| 3,915,097 | 10/1975 | Young, Jr. . | |
| 3,931,894 | 1/1976 | Murphy | 211/189 |
| 3,977,529 | 8/1976 | Stroh . | |
| 3,986,756 | 10/1976 | Kranich | 312/234.1 X |
| 4,146,139 | 3/1979 | von Stein et al. | 211/126 |
| 4,175,807 | 11/1979 | Kranich et al. | 312/118 |
| 4,226,190 | 10/1980 | Ashton . | |
| 4,226,193 | 10/1980 | Gindel . | |
| 4,241,777 | 12/1980 | Wenger et al. | 160/135 |
| 4,267,931 | 5/1981 | Belotta | 211/181 X |

*Primary Examiner*—J. Franklin Foss
*Assistant Examiner*—Blair M. Johnson

[57] ABSTRACT

A modular display unit having upper and lower wall panels, side panels, and a rear end panel, the front of such unit being open, interlock connectors extending upwardly and inwardly from the upper wall panel, and downwardly and inwardly from the lower wall panel, being interengageable with corresponding interlock connectors on adjacent units for vertical stacking, whereby said lower panel means of one said unit rests generally square against said upper panel of an adjacent lower said unit, and further having display panel supports extending forwardly from one side of the unit to receive a display panel and having information supports attached to the unit, to receive product information.

9 Claims, 7 Drawing Figures

106
114
116

104
112
110
113
108

36a
36b
30
38
38a
38b
40

REVERSIBLE ANGLE DISPLAY

The invention relates to a modular display system for use in the storage and display of products for sale, and is of particular utility in a so-called "angle display" system.

The display of goods for sale in a retail store requires a variety of different characteristics. The products themselves must be readily displayed, and the pricing must also be readily visible. In addition, it is desirable if the product actually sold is stored alongside its own display.

Preferably, all of these factors should be incorporated in a retail product display, such that an essentially self-service type of display is provided.

Customers may first of all see the entire range of products available and then make their choice, and determine on the availability of actual supply in stock, all without the assistance of a sales clerk.

Some products are such that in packaged form, they are not readily visible for examination by a customer. It is then desireable to have a special product display alongside the packaged product so that customers may get a complete picture of what they are buying. This is particularly true in the case of wallcovering materials such as wallpaper, but is also true in a wide variety of other materials such as paints, panelling, tiles, cloth of various kinds, to name only a few of a wide variety of such products.

In the particular case of wallpaper, the paper is customarily sold in rolls, and the customer in the past, has usually made a selection by studying display panels of wallpaper incorporated either in books, or on separate panel displays. Typically, the panel displays are hinged and a customer will leaf through the various displays.

Various problems are encountered with these systems. In particular, it is difficult for two or more customers to look at the same display panels simultaneously. The panels are swung to and fro, and one panel will thus obscure the view of all the others. In addition, the displays tend to become worn and unsightly, and must be replaced or serviced at regular intervals.

An additional, more serious problem is the fact that the customer is required to take an active role in the selection process. The customer must either leaf through books of display panels, or else swing various forms of hinged displays, while attempting to make a selection. This may be difficult for smaller people, persons accompanied by children or pets, handicapped persons and the like, all of whom may need the assistance of sales clerk.

In addition to these problems, it is desirable that the pricing information be available on each of the display panels. In many cases this is impractical, and a separate pricing list is supplied which must then be related to the display panels themselves.

Clearly, with the various disadvantages as indicated, it is desirable to provide for a more efficient form of display of products of this type, as well as many other products, such that the display is always visible, does not have to be moved around by the customers, and is directly associated with the stored product in such a way that the display can be related to the supply of product on hand.

Another incidental factor is that this greatly facilitates the work of the sales clerk. The sales personnel will have an immediate visual check of inventory of each individual product in relation to its display, without having to make a separate check of inventory in some other storage facility, as was the case in the past.

Various solutions have been proposed to alleviate this problem. For example, U.S. Pat. No. 3,986,756 discloses a form of angle display, in which a system of vertical partitions and horizontal spaced apart shelves, provide columns of recessed shelves for storing product, with associated display panels for displaying the product.

The construction of such a display system was however relatively expensive and inefficient, and required a substantial investment on the part of the store owner. In addition, it was not easily moved around, if it was desired to rearrange the display.

Another form of such angle display is shown in U.S. Pat. No. 4,175,807. This patent shows a more developed form of construction for the display, such that it can be erected and taken apart. However, the components are relatively complex and expensive, and must be interlocked with one another in a particular manner. Unless it is securely fastened each time it is erected, the system may be liable to flex or move, and if any one component is missing, it cannot be put together.

In addition, it requires a certain degree of manual dexterity on the part of the persons erecting the display. The sales personnel available in the store may not have the ability to carry out these tasks, and it may be necessary to hire trained servicemen for the purpose.

For all of these reasons, therefore, it is clearly desirable to provide an angle display system in which the construction is truely modular and self-supporting, and can be erected in a variety of different shapes and arrangements, and in which each module is a complete composite unit so that it does not require the cooperative support of adjacent units, or any other supporting structure, but can simply be stood on a floor.

BRIEF SUMMARY OF THE INVENTION

With a view to providing the foregoing advantages, the invention will be seen to comprise a modular display unit having upper and lower wall panels, side and a rear end panel means, the front of such unit being open, interlock means extending upwardly from said upper wall, and interlock means extending downwardly from said lower wall, said interlock means being interengageable with corresponding interlock means on adjacent said units, for vertical stacking, display panel support means extending forwardly from one of said sides of said unit, and adapted to receive a product display panel therein, and further having product information display support means attached to said unit, and adapted to receive a product information card therein.

More particularly, the invention seeks to provide a modular display unit having the foregoing advantages wherein the upper and lower panels are formed of wire rod material, and wherein said side panels are formed of a plurality of generally upright wire rods extending between said upper and lower panels.

More particularly, it is an objective of the invention to provide a modular display unit having the foregoing advantages wherein said interlock means are comprised by upward and downward extensions of said side panel rod members, said extensions being formed in a generally U-shape, and being interlockable with corresponding said interlock means on adjacent said modular units.

More particularly, it is an objective of the invention to provide a modular display unit having the foregoing advantages which is reversible, that is to say it may be used either way up.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

As shown generally in FIG. 1, an angle display system will typically be seen to comprise a plurality of separate individual modular display units indicated generally as 10, which are individually separable from one another in a manner to be described below. In the particular arrangement shown in FIG. 1, such display units 10 are stacked in vertical columns and are arranged in an essentially angularly offset manner, so as to provide a plurality of vertically arranged bins indicated generally as 12 for storage of product, each of which is juxtaposed with its own individual display panel indicated generally as 14.

It will of course be apparent that such a display can be erected in a variety of different configurations, and at essentially different angles, and can be dismantled depending upon the requirements of the individual retailer.

To facilitate inspection and selection by customers, information display panels indicated generally as 16 are also provided for each of the display units 10. Obviously, such information panels may contain pricing information, product specifications, dimensions, materials, and the like, all of which may be required by the customer before making his selection.

Figure 3:
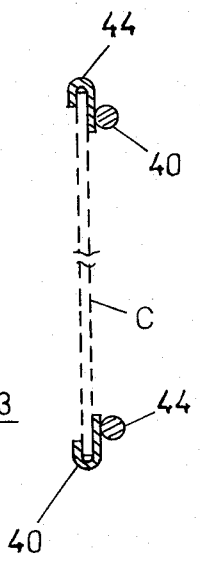
FIG. 3 is a section along the line 3—3 of FIG. 2.
Figure 2:
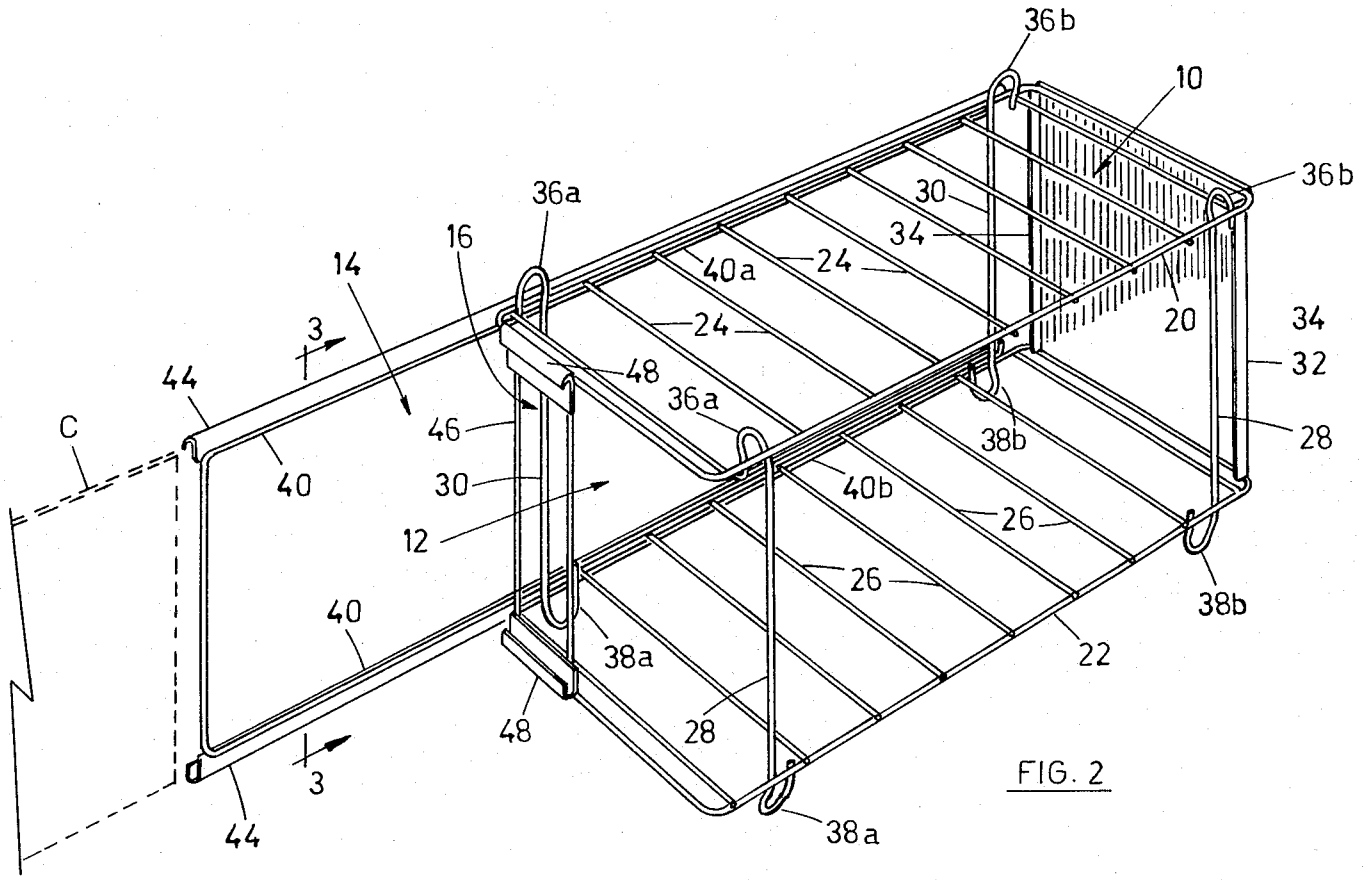
FIG. 2 is a perspective illustration of a modular display unit according to the invention.
Figures 4, 5, 6:
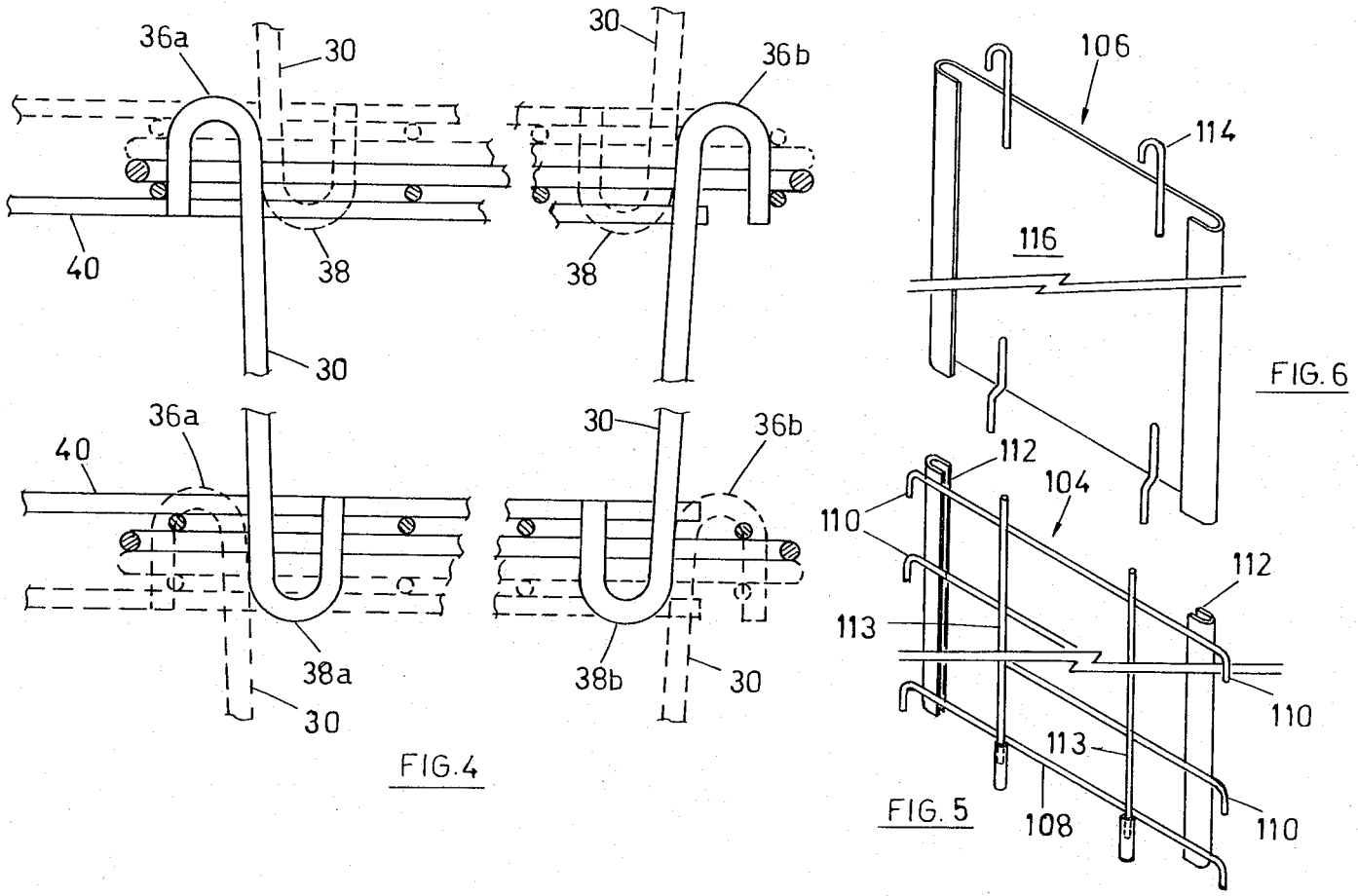
FIG. 4 is a partial side elevational view of the display unit of FIG. 2.
FIG. 5 is a perspective illustration of one form of accessory panel.
FIG. 6 is a perspective illustration of another form of accessory panel.

Referring now to FIGS. 2, 3 and 4, each of the modular units 10 will be seen to comprise upper and lower generally rectangular wire rod frameworks 20 and 22, each of which are provided with a plurality of cross-support struts 24-26, a plurality of such struts being provided, depending upon the nature of the product to be stored.

Clearly, where the product to be stored is rolls of wallpaper, then such struts 24 can be spaced relatively far apart and do not therefore have to be numerous.

On the other hand, if other product is to be stored, it may be desirable to provide some other form of supporting structure between the frames 20 and 22, such as interlocking open-weave wire mesh, sheet metal panels, or any other suitable material.

In any event, and whatever the materials which are used, the upper and lower frameworks 20 and 22 respectively define upper and lower panels for the purposes of the present invention, such being considered as "panels" whether the same define substantial open spaces, as in the present embodiment, or wheter the same are comprised of other forms of supporting material.

On either side of frames 20 and 22, there are a plurality of generally upright side support struts 28 and 30. In the case of the present embodiment only two such support struts 28 and 30 are shown on each side. This is found to be adequate when storing products such as wallpaper rolls. On the other hand, where some other forms of product are to be stored, then other forms of support may be desirable, such as a larger number of such wire rods, or open-weave wire mesh material, or sheet metal panels, or the like, depending upon the nature of the product.

In any event, for the purpose of the present invention, such struts 28 and 30 will each be deemed to comprise respective side "panels" which, together with the top and bottom panels define a generally rectangular cube-shaped enclosure or bin indicated generally as 12 which is shaped and adapted to provide storage space for product, typically in this case being rolls of wallpaper.

A generally rectangular piece of sheet metal 32 is provided between the rear portions of the upper and lower frames 20 and 22, and this forms a rear "panel" for the purposes of the present invention. In the present case, such rear panel is made of sheet metal so that when rolls of wallpaper are inserted into the recess 12, they will not be ejected from the opposite end. Similarly, if such rolls of wallpaper should be inserted with excessive force, then they will simply be checked by contact with the sheet metal, and the edges of the wallpaper will not become crushed or damaged.

Again, depending upon the type of product being stored, the rear panel may be made of a variety of other materials.

In the present case, such rear panel 32 is preferably formed with generally L-shaped end flanges 34, to give it increased strength, and also to facilitate attachment to the frames 20 and 22 which will typically be by spot welding or the like.

In order to interlock the modular units 10 one above the other, upwardly extending interlocking tabs 36 are provided, being upward extensions of the rods 28 and 30. Similarly, downwardly extending interlocking tongues 38 are provided being downward extensions of rods 28 and 30. The tongues 36 and 38 are formed as generally U-shaped bends, by continuations or end-wise extensions of such rods 28 and 30, and are thus integrally formed therewith. The four rods 28 and 30 are fastened to the frames 20 and 22 where they intersect, typically by spot welding or the like and the free ends of the tongues 36 and 38 are likewise fastened, typically by spot welding.

It will however be noted that the upper tongues 36 are formed as U-bends extending away from one another. Thus the forward pair of tongues 36*a* are directed forwardly, and the rearward pair of tongues 36*b* are directed rearwardly.

However, the lower tongues 38 are U-bends extending towards one another, that is to say the forward pair of tongues 38*a* is directed rearwardly and the rearward pair of such tongues 38*b* is directed forwardly.

In addition to this, the tongues 36 and 38 are located so that a pair of forward and rear lower tongues 38 and 38*b* can fit between a pair of forward and rear upper tongues 36*a* and 36*b*, when the units 10 are stacked one above the other (see FIG. 4).

In this embodiment, this is achieved by simply locating the rods 28 and 30 at a slight angle to the perpendicular. The amount of the angle will depend upon the thickness of the rod material 28 and 30, in this case. Essentially, all that is required is for the rods 28 and 30 to be offset as between their upper and lower ends by an amount equal to the thickness of such wire material.

This however can of course be achieved in various ways, for example, it is possible that a bend or form of dogleg could be inserted in the wire rods 28 and 30 anywhere along their length to achieve the same result.

All of such tongues 36 and 38 will preferably be bent inwardly (FIG. 2) at a slight angle so as to facilitate stacking.

In order to support a product display card, a display frame 40 is formed of wire rod material, and is fastened between upper and lower frames 20 and 22 adjacent one side thereof. In the case of the embodiment as shown, the display frame 40 is located on the same side as the sides 30—30. The frame 40 is dimensioned so that its upper and lower portions 40*a*-40*b* will fit within the spacing defined between the upper and lower frames 20 and 22 and is typically fastened by for example spot welding.

In order to support a display panel or card, a pair of elongated sheet metal channel members 44 are fastened to the frame 40, typically by spot welding.

As best shown in FIG. 2, such sheet metal channels will receive a card indicated in phantom as C, which may be slid along the length of the channels 44, and will thus be displayed to one side of the bin 12. Typically, the display panel or card C will display a portion or panel of the wallpaper being stored within the bin 12, so that a customer may see the pattern of the product in the bin.

In order to provide further customer information, an information display frame 46 is provided, consisting of a pair of generally upright parallel wire rods extending between the front portions of frames 20 and 22.

Upper and lower sheet metal channels 48 are provided for receiving an information card (not shown). Typically, the information card will contain product information such as materials, specifications, dimensions, price and the like.

The frame 46 will thus obscure a portion of the front opening of bin 12. However, this is not felt to be a disadvantage since the remainder of bin 12 is readily open to free access for insertion and removal of products such as rolls of wallpaper or the like.

It will thus be seen that the units 10 according to the invention may readily be stacked one above the other, with the tongues 36 and 38 interlocking with each other, and fitting within the frames 20 and 22, providing a secure interlocking fastening arrangement, whereby such modular units 10 may simply be stacked one above the other to make any suitable form of display arrangement.

In many cases, it is not found necessary to provide any attachment between adjacent columns of such stacked units 10. For example, as shown in FIG. 1, some such columns of units 10 may be simply juxtaposed or moved alongside one another in any desired configuration, and others may be interconnected.

It will of course be appreciated that the units 10 as shown in FIG. 2 may be used upside down where desired. Thus the reference herein to upper and lower frames 20 and 22 is simply for the sake of simplicity and description in relation to FIG. 2.

Such wording will clearly have reference to the position of the members as shown in FIG. 2, and is not intended to limit the structure to use only in that configuration or orientation as shown.

Figure 7:
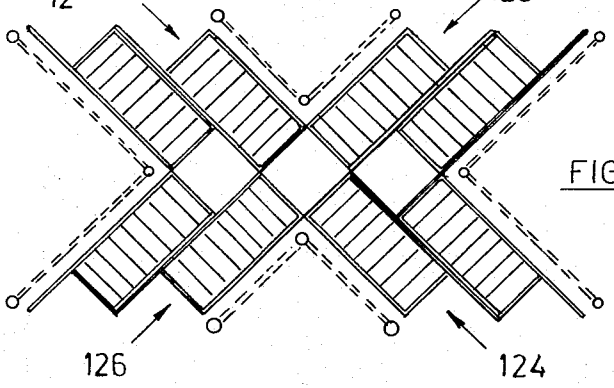
FIG. 7 (alongside FIG. 1) is a plan view of a further arrangement of the display system.

The great degree of flexibility in arranging different forms of display, which is achieved by means of the invention, permits a wide variety of different lay-outs. In some cases the display may be arranged on a wall. However, in many cases, it will be desirable to arrange free-standing displays at various locations on the floor of a retail space, for example, and in this case such arrangements may for example be laid out as shown in FIG. 1 or 7. It will of course be appreciated that the two arrangements shown are merely exemplary of the wide variety of different systems which might be used in different circumstances.

Figure 1:
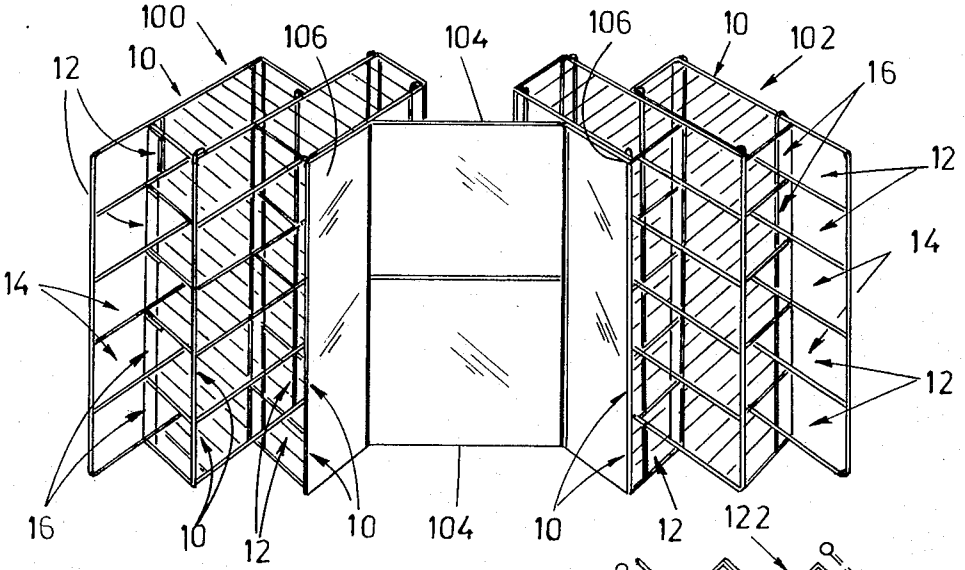
FIG. 1 is a schematic perspective illustration showing a typical angle display system formed by the modular display units of the invention.

Thus, the arrangement shown in FIG. 1 will be seen to comprise a plurality of display units 10, arranged in the right and left-hand groups indicated generally as 100 and 102. The display units 10 in the left-hand group 100 are rotated at an angle of about 45°, so that their display panel support portions are directed to the left, and the display units 10 in the right-hand group 102, are arranged with their display panel support portions directed to the right. In this way, a display which might be considered as a fan-shaped display is arranged. The space between the left and right-hand groups 100 and 102 is essentially in the form of a triangular recess. In order to make the best use of this space, panels 104 are removably fastened between the two groups of display units, such panel 104 being constructed essentially as shown in FIG. 5.

Cover panels 106 may also be used, flanking the panel 104, and also being removably attached to the units 10.

The panels 104 and 106 may be used to support additional information or advertising displays, or booklets, or in some cases may be provided with a suitable system of hooks, for supporting a variety of products for sale.

Typically, where the units 10 are used for displaying wallpaper, hand tools and accessories useful for decorators would be displayed on the panel 104, for example, so as to provide a unified self-contained product display.

As shown in FIG. 5, the panel 104 will typically be formed of wire rod material, having a plurality of cross members 108, formed with downwardly turned hook portions 110 at either end, and carrying channels 112.

A plurality of vertical members 113 will intersect the cross-members, and will typically be fastened thereto by spot welding.

Typically, the cross-members will be located at predetermined, spaced-apart vertical locations, such that the hooks may be interengaged with suitable portions of the display units 10. In this way the panel 104 may be made releaseably attachable. In addition, the panel 104 provides a certain degree of cross bracing support for the display units 10, although in practice this is not found to be required in the majority of cases.

The filler panels 106 may be of a variety of different constructions, again essentially based on wire rod as the raw material. In this case the panels 106 are made up with vertical members having hook portions 114, which engage either with portions of the display units 110, or provide some form of interlocking nesting attachment one above the other, so that a number of different panels may be used, depending upon the height of the complete display. Again, the panels 106 can also be used to carry information or product display or advertising, or for any other purpose.

They may be provided with sheet metal faces 116, attached or spot welded to the wire rod material.

Still another arrangement of the display units according to the invention is shown in FIG. 7. In this case, when viewed from above, the display units are arranged more or less in the shape of the letter X. Four groups of units 10 are shown, namely groups 120, 122, 124 and 126. The four groups are arranged in a manner essentially similar to the two groups 100 and 102 in FIG. 5, with two such groupings being arranged back to back.

In this case, however, the grouping defines four triangular spaces between respective groups. Again, these spaces are covered up or filled in by means such as the panels shown in FIGS. 5 and 6, or other forms of panels, which may carry display advertising, details of products, pricing, or which may be used as product display for other forms of items for sale.

This latter arrangement is particularly suited to use in an open plan retail space, where the units must be arranged in groups or blocks, away from any wall.

This form of arrangement makes particularly good use of the floor space available in a retail area, and also ensures that the customers shall move around freely from one display to another, without crowding around the walls of a retail store, while leaving the centre of the floor empty.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A modular display unit for the combined storage and display of products for sale and comprising:

upper and lower panel means formed of wire rod construction;

side panel means formed of wire rod construction;

rear end panel means, the front of such unit being open, thereby defining a generally rectangular bin open at one end for storing products therein;

upper tongue means formed by wire loops extending upwardly and inwardly from said upper panel means extending on predetermined first axes;

lower tongue means formed by wire loops extending downwardly and inwardly from said lower panel means, extending on predetermined second axes offset from said first axes whereby said upper and lower tongue means are interengageable with adjacent said units for vertical stacking of such units to form stacks of such bins, whereby said lower panel means of one said unit rests generally square against said upper panel means of an adjacent lower said unit;

display panel support means extending forwardly form one of said sides of said unit, and adapted to receive a product display panel therein for a display related to product stored in such bin, and, product information display support means attached to said unit, and adapted to receive a product information panel related to such product stored in such bin.

2. A modular display unit as claimed in claim 1 wherein said interlock means comprise upper and lower tongue members, arranged in pairs on opposite sides of said upper and lower panel means, some pairs of said tongue members being spaced apart further than other of said tongue members, whereby one pair of said tongue members may be received between another pair of said tongue members when interlocked as aforesaid.

3. A modular display unit as claimed in claim 2 wherein said display panel support means comprises a pair of channel members, adapted to receive display panel means therein in slidable relation, thereby permitting insertion and removal of exchangeable display panels, whereby the display on such display panels may be related to the product stored in the adjacent bin, and whereby said panel may provide structural support to said unit.

4. A modular display unit as claimed in claim 3 wherein said product information display support means further comprises a pair of channel members spaced apart to receive an information display panel therein, said panel being replaceable, whereby the product information on such panel may be related to the product stored in the adjacent bin, and whereby said panel may provide structural support to said unit.

5. A modular display unit as claimed in claim 4 wherein such product information display support means partially extends across said open end of said bin.

6. A modular display unit as claimed in claim 3 wherein said display panel support means further includes channel supporting members extending from one of said side panel means of said unit, thereby locating said product display panel forwardly of an adjacent one side of said open end of said bin.

7. A modular display unit as claimed in claim 3 wherein said display panel support means includes upper and lower wire rod members extending from one side of said unit adjacent said open end, and including a pair of channel members attached to said wire rod members, for receiving a display card therein, thereby locating such display card adjacent said open end of said bin.

8. A modular display unit as claimed in claim 1 including filler panel means, and hook members on said filler panel means interengageable with said display units, whereby said display units may be arranged to form two adjacent angle displays, oriented in different directions, with a said filler panel interconnected between them.

9. A modular display unit as claimed in claim 8 including a pair of channel members on said filler panel for receiving a supporting member therein.

* * * * *